US005327754A

United States Patent [19]

Hein

[11] Patent Number: 5,327,754

[45] Date of Patent: Jul. 12, 1994

[54] METHOD AND APPARATUS FOR CONTROLLING THE PASSAGE OF ROLLED STOCK OF LITTLE LONGITUDINAL TENSILE STRENGTH THROUGH A CONTINUOUS ROLLING MILL

[75] Inventor: Otto Hein, Steyr, Austria

[73] Assignee: GFM Gesellschaft für Fertigungstechnik und Maschinenbau Aktiengesellschaft, Steyr, Austria

[21] Appl. No.: 971,337

[22] Filed: Nov. 4, 1992

[30] Foreign Application Priority Data

Nov. 11, 1991 [AT] Austria ..... 2222/91

[51] Int. Cl.[5] ..... B21B 1/22; B21B 37/00

[52] U.S. Cl. ..... 72/14; 72/20; 72/234

[58] Field of Search ..... 72/6, 14, 19, 20, 28, 72/234

[56] References Cited

U.S. PATENT DOCUMENTS

| | | | |
|---|---|---|---|
| 1,466,642 | 8/1923 | Crook | 72/234 |
| 3,110,203 | 11/1963 | Stringer | 72/14 |
| 3,457,747 | 7/1969 | Yeomans | 72/19 |
| 4,287,738 | 9/1981 | Hojas et al. | 72/20 |

FOREIGN PATENT DOCUMENTS

| | | | |
|---|---|---|---|
| 383059 | 5/1987 | Austria . | |
| 0008037 | 2/1980 | European Pat. Off. . | |
| 2413492 | 10/1975 | Fed. Rep. of Germany . | |
| 0286615 | 12/1987 | Japan | 72/234 |
| 0055609 | 2/1990 | Japan | 72/234 |

*Primary Examiner*—Lowell A. Larson
*Assistant Examiner*—Thomas C. Schoeffler
*Attorney, Agent, or Firm*—Collard & Roe

[57] ABSTRACT

In controlling the passage of rolled stock under little longitudinal tensile stress through a continuous rolling mill by secondary-controlled hydrostatic drives for the individual rolling stands, the rotary speeds of the hydromotors associated with the drives are controlled by adjusting their displacement volumes. To obtain a rational and dependable control method, at the beginning of the passage of the stock, all but one of the rotary speed controls for the hydromotors belonging to the stands through which the stock has passed and the stand through which the stock passes next as the passage of the stock through the stands proceeds are consecutively interrupted during the consecutive passing of the stock through the rolling stands and, therefore, at any time only the hydromotor of one of the stands, the guiding stand, is operated with an adjustable displacement volume for controlling the rotary speed at least as long as the stock passes through all the stands.

6 Claims, 1 Drawing Sheet

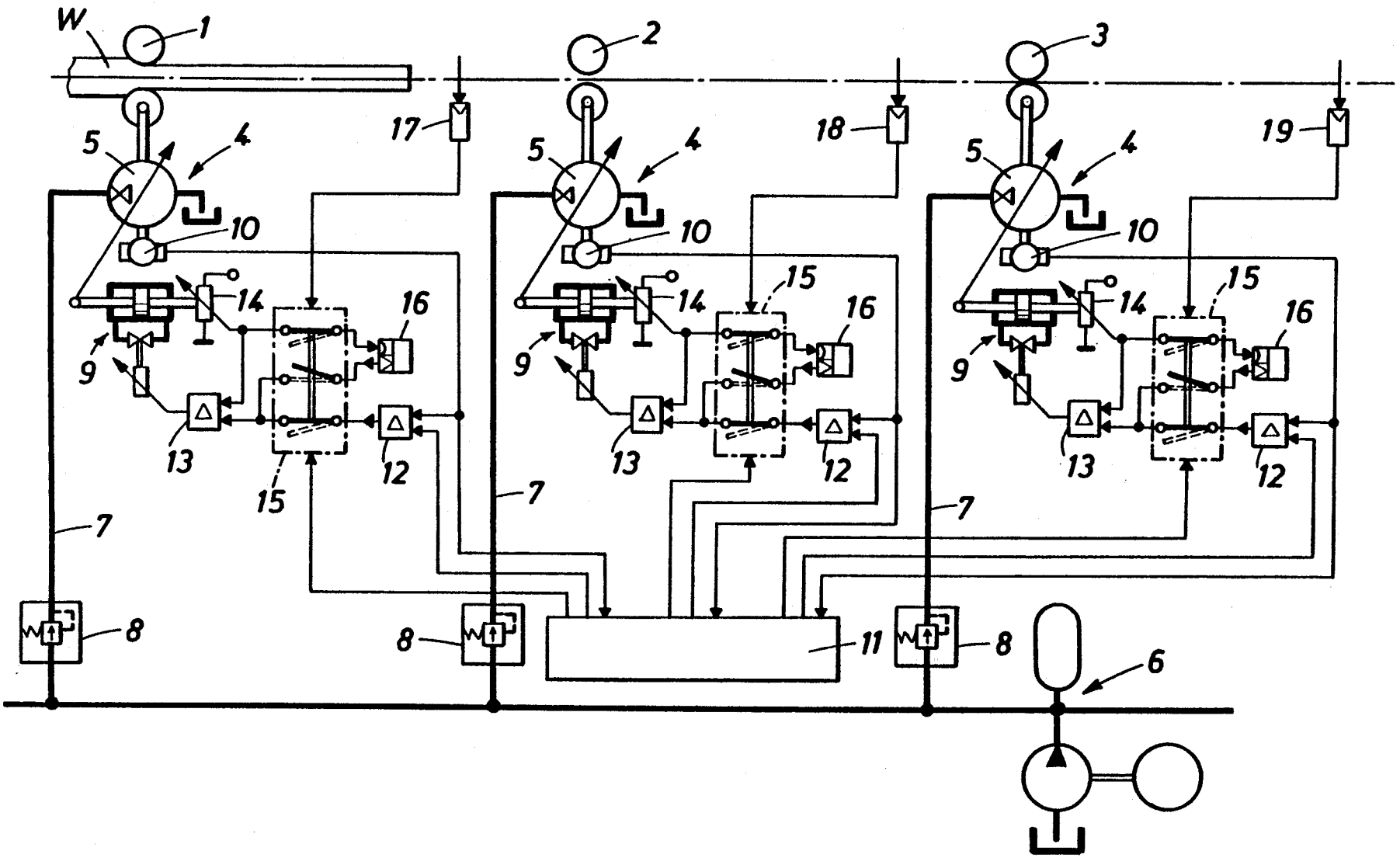
1
2
3
4
5
6
7
8
9
10
11
12
13
14
15
16
17
18
19
W

METHOD AND APPARATUS FOR CONTROLLING THE PASSAGE OF ROLLED STOCK OF LITTLE LONGITUDINAL TENSILE STRENGTH THROUGH A CONTINUOUS ROLLING MILL

BACKGROUND OF THE INVENTION

1. Field of the Invention

The invention relates to a method for controlling the passage of rolled stock under little longitudinal tensile stress through a continuous rolling mill by secondary-controlled hydrostatic drives for the individual rolling stands, the rotary speeds of the hydromotors associated with the drives being controlled by adjusting their displacement volume.

2. Description of the Prior Art

Several rolling stands are arranged sequentially in a continuous rolling mill, in which slabs, billets or the like are rolled to obtain a desired gage by successively reducing the cross section of the material by a predetermined amount. Because of the condition of continuity of the passage of the rolled stock through the rolling mill, the product of the material cross section and the rolled stock speed is constant at each point and, therefore, the rotary speed of the rolls must increase substantially proportionally to the decrease in the cross section from stand to stand. Since it is desired to obtain a rolled stock passage which is as free as possible from tensile and compression forces and no method has been available heretofore to permit the required rotary speeds of the rolls to be calculated beforehand, a good rolling result depends on a suitable rotary speed control, it being impossible, however, to measure the tensile and pressure forces prevailing in the rolled stock wherefore they cannot be used as guiding parameters for the control of the rotary speed.

Various control methods are known for rolling mills with direct current motors for the rolling stand drives, which operate, for example, during the passing stage with a guiding stand operated at constant speed and with individually adjustable rotary speed governors at the other stands (EP-A1000 8037) or in which the rotary speed control circuit of each stand through which the stock passes is separated and this stand is controlled until the stock passes through the next stand by a subsidiary torque control circuit in dependence of a change in the drive torque of the preceding stand (DE-OS 2 413 492). However, this has the fundamental disadvantages of an electrical drive and the high costs of the computer circuits and the measuring devices.

In contrast to the electrical drives, hydrostatic drives for continuous rolling mills have found favor because of their compact construction, their high efficiency and their low inertia, secondary-controlled drives being usually preferred. In a secondary-controlled hydrostatic drive, a common pressure medium system comprised of pumps and hydro-accumulators supplies a constant pressure to the hydromotors so that it is not necessary to provide a separate pumping station for each hydromotor and a considerable saving may be obtained in driving power. In these secondary-controlled drives, the displacement volume of the hydromotor may be steplessly adjusted by an adjustment device from zero in both directions and the rotary speed of the motor may be controlled by the change in the displacement volume. If the prevailing rotary speed is compared to a predetermined desired rotary speed by a control device and the control device is controlled in dependence on the comparison between the prevailing and desired values, the load may be held to the desired rotary speed when the drive torque changes. Because of the supplied pressure at the inlet of the motor, the displacement volume of the hydromotor is proportional to resulting torque of rotation at a predetermined rotary speed so that a specific displacement volume is produced at the motor at a predetermined rotary speed and a given torque of rotation. To prevent a substantial break in the rotary speed when the torque of rotation is suddenly changed, pressure relief valves or like devices are built into the pressure supply line for the hydromotors to prepare the motor for the sudden change of the torque of rotation by properly changing the pressure supplied to the motor inlet and the proportional change in the displacement volume. This, however, has basically no significance for the rotary speed control proper.

In the control of the rolled stock passage through a continuous rolling mill with secondary-controlled hydrostatic drives, it is known from AT-S 383 059 to make use of the position changes of the adjustment devices of the individual hydromotors for correcting the rotary speed of the hydromotors for the adjacent rolling stands to hold the tensile forces during the passage of the rolled stock as low as possible. This control method, however, also requires high-cost measuring techniques for determining the position changes of the adjustment devices and also high-cost computer techniques for calculating the required rotary speed corrections for the adjacent rolling stands.

SUMMARY OF THE INVENTION

Therefore, it is an object of the invention to overcome these disadvantages and to provide a control method of the first-described type which assures a passage of rolled stock under little longitudinal tension in a very effective manner. In addition, a very simple apparatus for carrying out this method is provided.

The invention accomplishes this object in that, at the beginning of the passage of the stock, all but one of the rotary speed controls for the hydromotors belonging to the stands through which the stock has passed and the stand through which the stock passes next as the passage of the stock through the stands proceeds, in a known manner, are consecutively interrupted during the consecutive passing of the stock through the rolling stands and, therefore, at any time only the hydromotor of one of the stands, the guiding stand, is operated with an adjustable displacement volume for controlling the rotary speed at least as long as the stock passes through all the stands.

Therefore, use is made for the control of the rolled stock passage of the characteristic of a secondary-controlled drive that an interruption of the rotary speed control during the controlled state of inertia does not result in a change in the rotary speed as long as the torque of the drive also remains unchanged. However, a change in the torque results in a change in the rotary speed, which can be calculated from the change in the torque and the moment of inertia of the motor and load. In other words, the hydromotor accelerates as the drive torque decreases and when the drive torque is increased, the hydromotor correspondingly slows down. Therefore, when during the passage of the rolled stock through a continuous rolling mill the rotary speed control, except for one, is switched off at the proper torque, the one stand whose rotary speed is controlled serves as guiding stand for maintaining a given rolling speed and the other stands automatically adjust their rotary speed in dependence on the prevailing drive torque based on the tensile and compression loads, for which purpose no costly measuring and computing devices are needed.

It is quite possible to use the first rolling stand of the rolling mill constantly as the guiding stand for the whole passing stage and the entire passage of the rolled stock and to switch off the rotary speed control of the hydromotors of the succeeding stands step by step as the rolled stock progressively passes through these stands, or to use each rolling stand through which the rolled stock passes as guiding stand before the stock passes through the next stand, which brings about certain uncertainties, however, with respect to the predetermination of the desired rotary speeds of the following stands. It is, therefore, particularly advantageous if, according to the invention, the rotary speed control for the hydromotor of the last stand through which the stock passed is interrupted before the stock is passed through the succeeding stand, and then remains interrupted at least until the stock has passed through all stands. In this way, as the stock progressively passes through the stands, each stand through which the stock passes becomes the guiding stand whose rotary speed control is maintained until shortly before the stock passes through the succeeding stand, and the preceding stands through which the stock has passed, which operate with a steady displacement volume of their hydromotors, control their rotary speed automatically to attain a passage of the stock free of tensile and compression forces. Therefore, it is sufficient for the rolling stands to maintain the desired rotary speed values calculated from the roll diameter, material cross section, speed of the rolled stock etc. before each passage of the rolled stock, for which purpose no costly control techniques are required, and the desired passage control is then obtained by the simple measure of switching off the rotary speed control for the last stand through which the stock has passed before it passes through the succeeding stand.

This control method functions accurately only if the rolling conditions remain approximately the same during the passage of the rolled stock. Primarily, the forming torque should not change since this brings about a change in the drive torque of the stands, and the control of this change in the torque cannot be differentiated from a change in the torque due to a change in the longitudinal force. In hot rolling, a sinking temperature gradient can most often be observed so that the tension in the rolled stock would steadily increase in the rolling mill towards the colder end of the rolled stock since the individual rolling stands become slower and slower because of the increasing forming torque. To counteract this, the rotary speeds of the hydromotors associated with the individual stands through which the rolled stock passes and which adjust themselves after the stock passes through the last stand as the stock passes through all the stands are detected and stored, whereupon the interruption of the rotary speed control ceases and the rotary speeds of the hydromotors of all the stands are controlled by using the stored speeds as corresponding desired rotary speeds during the subsequent passage of the rolled stock. In this way, the rotary speeds adjusted at the rolling stands under substantially the same forming conditions can be used as desired rotary speeds for the rolling after the stock has passed through the last stand and the individual stands may be adjusted to these desired rotary speeds whereby the automatic rotary speed adaptation is lifted again and the influence of the increasing forming torque on the rotary speed of the rolls is forestalled.

In secondary-controlled hydrostatic drives for the individual rolling stands with an adjustment device for adjusting the displacement volume of the associated hydromotor and a control device for controlling these adjustment devices in dependence on a comparison between the existing and desired values of the rotary speeds, a useful apparatus for carrying out the method according to the invention is obtained by providing for all hydromotors, except at most one, a circuit breaker in the control circuit between the control device and the adjustment device, the circuit breaker being actuatable by a transmitter or the like detecting the beginning of the rolled stock in the direction of the passage ahead of, or behind, each associated rolling stand. Therefore, the secondary-controlled hydrostatic drive must be supplemented solely by a circuit breaker for the rotary speed control to enable the passage of the rolled stock to be controlled satisfactorily. This circuit breaker serves for the active or inactive control of the rotary speed of the respective hydromotors, depending on its switching position, and produces a constant rotary motor speed independent of the drive torque in the normal circuit position and a variable rotary speed dependent on the drive torque in the circuit breaking position. The timing of the circuit breaker actuation may be obtained without problems by a simple pickup, for example a photo sensor which detects the beginning of the rolled stock with respect to a respective rolling stand. It is also possible to use the control device for the circuit breaker actuation since it can simply calculate the timing of the switching of the circuit breaker on the basis of the speed of the rolled stock and the distance between the rolling stands. Advantageously, circuit breakers are associated with each hydromotor but it would also be possible to permit the hydromotor for one stand used as the guiding stand to run constantly with an actuated rotary speed control. The values of the rotary speed pickups read in the control device could then be compared as existing values with a predetermined desired value or stored as a desired value for a later comparison of existing and desired values so that it is possible not only to effectuate the usual rotary speed controls of the individual hydromotors but also to store the actual rotary speeds adjusted during the passage of a rolled stock under little longitudinal tension and to use them as desired values for the rotary speed control of later or other rolling operations, particularly to compensate for temperature-conditioned changes in the forming torque or the like.

BRIEF DESCRIPTION OF THE DRAWING

The drawing illustrates the subject matter of the invention by way of example in connection with an installation diagram of a rolling mill according to the invention.

DESCRIPTION OF THE PREFERRED EMBODIMENTS

A continuous rolling mill with three rolling stands 1, 2, 3 for rolling rolled stock W is schematically indicated, each rolling stand being driven by a secondary-controlled hydrostatic drive 4. Each of these drives comprises a hydromotor 5 and a common pressure oil system 6 which supplies a constant pressure to hydromotors 5 through supply lines 7. To avoid breaks in the rotary speeds because of sudden increases in the torque, pressure relief valves 8 or the like are mounted in supply line 7, which permit the supplied pressure, i.e. the oil flow, to be influenced in a determined manner to prepare the hydromotor for such an increase in the torque.

The displacement volume of hydromotors 5 may be steplessly adjusted by adjustment device 9 from zero in both directions, and a rotary speed indicator 10, for example an electrical tachogenerator, is provided for measuring the rotary speed. To control the rotary speed, there is provided a control device 11 and, for each adjustment device, an integrator 12, an amplifier 13 for controlling the adjustment device 9 and a displacement pickup 14 for detecting the position of the adjustment device so that adjustment device 9 is controlled in the direction of the change in the displacement volume of hydromotor 5 and the load is held to the desired rotary speed even if the drive torque is changed when the existing rotary speed value read by rotary speed pickup 10 deviates from the desired rotary speed value provided by control device 11.

Circuit breakers 15 are arranged in the control circuit between the adjustment device and control device 11 and the secondary control circuits are complemented by a memory device 16 for the measured value. The rotary speed control is maintained in the normal position of circuit breaker 15 and a change in the prevailing rotary speed value caused by a change in the torque causes a change in the motor displacement volume, which on its part results in an equilibrium between the prevailing and desired rotary speeds of the motor at the load torque existing at that instant. In this circuit position, the signal of the displacement pickup 14 is read into storage device 16 whose memory thus holds a value proportional to the displacement volume of the hydromotor. When circuit breaker 15 is switched into the position indicated in broken lines, the rotary speed control is interrupted and integrator 12 and amplifier 13 now carry a signal of displacement pickup 14 and a signal of measured value storage device 16. Since both signals are of the same magnitude at the moment of switching, adjustment device 9 and, therefore, the displacement volume of hydromotor 5 remain unchanged. The rotary speed of the motor also remains the same as long as the drive torque at the hydromotor corresponds to the drive torque before the switching. But when this drive torque changes, the rotary speed changes, too, a reduction of the load torque causing an acceleration of the motor and an increase in the load torque causing a deceleration of the motor since the rotary speed of the motor is inversely proportional to the drive torque when the displacement volume of the motor is constant.

Photo-sensors 17, 18, 19, which respond to the beginning and the end of rolled stock W and thus cause switching of circuit breaker 15, are provided for actuating circuit breaker 15.

Control device 11 feeds desired rotary speed values to hydrostatic drives 4 of the rolling stands, which are calculated from the diameters of the rolls, the cross section of the material, the speed of the rolled stock, etc., but are so selected that tensions in the rolled stock may be expected between the rolling stands even under unfavorable rolling conditions. The rolling stands idle at these desired rotary speeds before the stock passes through the rolling mill. Circuit breakers 15 are in their normal position and the rotary speed controls are activated. Pressure relief valves 8 cause hydromotors 5 to assume a displacement volume required to avoid substantial breaks in the rotary speed upon the appearance of forming torques as the stock passes through the rolling stands, which step is, however, insignificant for the control proper.

As stock W reaches the first rolling stand 1 and passes therethrough, the rotary speed control remains activated and hydromotor 5 reacts with changes in the displacement volume to maintain the desired rotary speed. Rolled stock W moves free of tensile and compression stresses to second rolling stand 2. When the beginning of the rolled stock reaches photo-sensor 17, which is arranged just ahead of the second rolling stand, circuit breaker 15 is switched to its circuit interrupting position (shown in broken lines) and interrupts the rotary speed control whereby the displacement volume of the hydromotor is held at the value reached just before the switching. Since it is not expected that the forming torque at rolling stand 1 changes while the beginning of the rolled stock passes through the path between photo-sensor 17 and succeeding rolling stand 2, the rotary speed of the rolls of rolling stand 1 and, therefore, the rotary speed of the motor remain unchanged.

When rolled stock W reaches rolling stand 2 which, according to the rotary speed value fed to it, runs a little faster than the theoretical rolling speed, rolling stand 2 will continue to maintain this rotary speed because of the active rotary speed control of associated hydromotor 5 while pressure relief valve 8 in supply line 7 prevents a break in the rotary speed here, too. Because of the higher rotary speed value fed to rolling stand 2, tension forces are applied to rolled stock W between rolling stands 1 and 2, which tension forces reduce the drive torque in rolling stand 1 so that, because the rotary speed control is interrupted there, the hydromotor is accelerated by the torque resulting from the tension force and its rotary speed is increased. The rotary speed increase continues until the tension forces in rolled stock W between rolling stands 1 and 2 disappear.

The passage of the rolled stock continues in the same manner at rolling stand 3 and any other succeeding rolling stands, photo-sensors 18 and 19 or the like switching circuit breakers 15 for rolling stand 2 and then rolling stand 3 before the rolling stock reaches rolling stand 3 or succeeding rolling stands so that only rolling stand 3 behind rolling stand 2 or the succeeding rolling stands operate with a rotary speed control as guiding stand. This guiding stand determines the rolling speed and the other rolling stands 1, 2, which operate without rotary speed control, can change their rotary speeds to reduce the tensile force in the rolled stock.

To avoid disturbing this control by changes in the rolling conditions, particularly by changes in temperature-conditioned forming differences, the existing value of the rotary speeds at the individual rolling stands 1, 2, 3 is fed to control device 11 and stored as soon as the beginning of the rolled stock has passed through the last rolling stand, whereupon circuit breakers 15 are brought back to their normal position and these stored existing values are fed again to the respective rotary speed controls. Thus, all rolling stands run at these rotary speeds until the rolled stock has passed through the rolling mill and differences in the forming torque can no longer influence the rotary speed.

I claim:

1. A method of controlling a continuous movement under minimal tensile stress of a stock to be rolled through a series of consecutive rolling mill stands comprising a pair of cooperating rolls, which comprises the steps of (a) driving the rolls of each rolling mill stand by a hydromotor having a rotary speed and a displacement volume, the rotary speed of each hydromotor being controllable by a control adjusting the displacement volume of the hydromotor, (b) supplying a constant pressure to the hydromotors by a pressure fluid supply system common to all the hydromotors, (c) controlling the rotary speed of each hydromotor of the consecutive rolling mill stands at a desired rotary speed before an initial section of the stock passes between the rolls of the consecutive rolling mill stands, (d) passing the initial stock section consecutively between the rolls of the consecutive rolling mill stands, and (e) when the initial stock section is positioned between each pair of consecutive upstream and downstream rolling mill stands, interrupting control of the rotary speed of the hydromotor of one of the upstream and downstream rolling mill stands between which the initial stock section is positioned, whereby the rotary speed of the hydromotor of at most one of the rolling mill stands through which the initial stock section has passed is controlled at least until the initial stock section has passed through all of the stands.

2. The method of claim 1, wherein control of the rotary speed of the hydromotor of the upstream rolling mill stand is interrupted when the initial stock section is positioned between the consecutive upstream and downstream rolling mill stands, and the control remains interrupted at least until the initial stock section has passed through all of the stands.

3. The method of claim 1, comprising the further steps of detecting and storing the rotary speeds of the hydromotors as the initial stock section passes through the rolling mill stands, restoring the interrupted rotary speed control of each hydromotor, and feeding the detected and stored rotary speeds to the restored rotary speed controls as a remaining section of the stock consecutive to the initial stock section passes through the rolling mill stands whereby the rotary speeds of the hydromotors are controlled by the rotary speeds detected and stored as the initial stock section passes through the rolling mill stands.

4. An apparatus for controlling a continuous movement under minimal tensile stress of a stock to be rolled through a series of consecutive rolling mill stands comprising a pair of cooperating rolls, which comprises (a) a hydromotor for driving the rolls of each rolling mill stand, each hydromotor having a rotary speed and a displacement volume, (b) an adjustment device for adjusting the displacement volume of each hydromotor, (c) a control for controlling the adjustment devices of the displacement volumes of the hydromotors in dependence on a comparison between existing and desired values of the rotary speeds, (b) a pressure fluid supply system common to all the hydromotors for supplying a constant pressure to the hydromotors, (c) a control circuit connecting the control to each one of the adjustment devices, the control circuit including (1) a circuit breaker arranged between the control and each adjustment device, and (d) a pickup between each two consecutive rolling mill stands for detecting an initial section of the stock after it has passed through one of the two consecutive rolling mill stands and before it passes through the consecutive one of the two stands, (1) the pickup actuating the circuit breaker in the control circuit arranged between the control and the one rolling mill stand whereby said control circuit is interrupted.

5. The apparatus of claim 4, further comprising an element connected to each hydromotor for indicating the rotary speed of the connected hydromotor and for transmitting an existing value corresponding to the indicated rotary speed to the control, and the control storing a desired value of the rotary speed for comparison with the existing rotary speed value transmitted thereto.

6. The apparatus of claim 5, further comprising a memory in the control for storing the transmitted existing rotary speed values.

* * * * *